US006640707B2

(12) United States Patent
Frankenberger et al.

(10) Patent No.: US 6,640,707 B2
(45) Date of Patent: Nov. 4, 2003

(54) DEVICE FOR GUIDING SHEETS IN A SHEET PROCESSING APPARATUS

(75) Inventors: Eckart Frankenberger, Darmstadt (DE); Michael Gieser, Oftersheim (DE); Christian Görbing, Heidelberg (DE); Peter Hachmann, Dossenheim (DE); Karl-Heinz Helmstädter, Heidelberg (DE); Christian Hieb, Neuhofen (DE); Ruben Schmitt, Heidelberg (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 38 days.

(21) Appl. No.: 09/944,579

(22) Filed: Aug. 31, 2001

(65) Prior Publication Data

US 2002/0023559 A1 Feb. 28, 2002

(30) Foreign Application Priority Data

Aug. 31, 2000 (DE) ..... 100 42 889

(51) Int. Cl.[7] ..... B41F 21/10; B41F 25/00
(52) U.S. Cl. ..... 101/232; 271/276
(58) Field of Search ..... 271/194, 195, 271/196, 197, 276; 101/232

(56) References Cited

U.S. PATENT DOCUMENTS

| | | | | | |
|---|---|---|---|---|---|
| 3,823,743 | A | * | 7/1974 | King | 138/42 |
| 4,043,360 | A | * | 8/1977 | Yaron | 138/42 |
| 4,384,524 | A | * | 5/1983 | Simeth et al. | 101/232 |
| 4,411,292 | A | * | 10/1983 | Schiller | 138/42 |
| 5,086,698 | A | * | 2/1992 | Wirz | 101/409 |
| 5,156,090 | A | * | 10/1992 | Wirz | 101/142 |
| 5,327,941 | A | * | 7/1994 | Bitsakis et al. | 138/42 |
| 5,546,858 | A | * | 8/1996 | Stephan | 101/142 |
| 5,706,726 | A | | 1/1998 | Stephan | |
| 5,816,155 | A | | 10/1998 | Stephan | |
| 6,457,409 | B2 | * | 10/2002 | Fujimoto | 101/232 |

FOREIGN PATENT DOCUMENTS

| | | |
|---|---|---|
| DE | 195 03 110 A1 | 8/1996 |
| DE | 195 23 076 A1 | 1/1997 |
| DE | 197 53 068 A1 | 6/1999 |
| DE | 197 53 089 A1 | 6/1999 |
| DE | 197 53 091 A1 | 6/1999 |
| DE | 198 29 095 A1 | 1/2000 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

In a device for guiding sheets in a sheet-fed apparatus, preferably, a rotary printing press, sheet guide elements that are charged with blasted air are disposed at the sheet guide cylinder, and the air blast nozzles include a combination of conventional free jet nozzles and throttled nozzles, which are independently charged with different pressure levels.

14 Claims, 6 Drawing Sheets

DEVICE FOR GUIDING SHEETS IN A SHEET PROCESSING APPARATUS

BACKGROUND OF THE INVENTION

FIELD OF THE INVENTION

The invention relates to a device for guiding sheets in a sheet-processing apparatus, particularly, a rotary printing press.

German Published, Non-Prosecuted Patent Application DE 198 29 095 A1 teaches the provision of sheet guiding devices that include an air-permeable guide surface made of porous material at cylinders and drums of rotary printing presses on either side of the printing nip. Diffuse blasted air emerging from the guide surface is intended to facilitate a uniform blasted air emergence. The sheet guiding devices according to DE 198 29 095 A1 are not suitable for smoothing out or pressing wrinkles from a sheet at a large distance in front of the feed nip as the sheet is transported on a sheet guiding cylinder at its front edge by grippers.

SUMMARY OF THE INVENTION

It is accordingly an object of the invention to provide a device for guiding sheets in a sheet processing apparatus that overcomes the hereinafore-mentioned disadvantages of the heretofore-known devices of this general type and that lays out a sheet guiding device having blast nozzles that makes possible a uniform sheet transport on a sheet guiding cylinder.

With the foregoing and other objects in view, there is provided, in accordance with the invention, a device for guiding sheets in a sheet-fed apparatus having a form cylinder, a rubber blanket cylinder, and a sheet guiding cylinder, the sheet guiding cylinder with one of the form cylinder and the rubber blanket cylinder forming a printing nip parallel to the sheet guiding cylinder, the device including at least one sheet guide disposed in a region of the printing nip. The at least one sheet guide has blast openings for guiding a sheet on a shell surface of the sheet guiding cylinder. The blast openings include a combination of free jet nozzles and throttled air blast nozzles.

An advantage of the invention is that the guide device represents a combination of conventional nozzles (free jet nozzles—with good response behavior even at greater distances of the sheet from the nozzle given large air throughputs), and throttled nozzles (having high air pressure in the near zone of influence given small distances between the nozzles and the sheet and given small air throughputs).

As such, the invention makes it possible to place the guide element with its front part having throttled blast nozzles in front of the infeed nip, e.g., the printing nip, (when viewed in a sheet transport direction), very close to the circumferential surface of the cylinder that transports the sheet. A back part of the guide element includes a number of blast nozzles (in any case, at least one) that already "press smooth" the sheet with their free jet further in front of the infeed nip.

In accordance with another feature of the invention, the at least one sheet guide is at least two sheet guides, one of the two sheet guides is disposed in front of the printing nip with respect to a sheet transport direction, and another of the two sheet guides is disposed behind the printing nip with respect to a sheet transport direction.

In accordance with a further feature of the invention, the throttled air blast nozzles are disposed closer to the sheet guide cylinder than the free jet nozzles.

In accordance with an added feature of the invention, the throttled air blast nozzles are charged with a blasted air pressure at a given pressure level, and the free jet nozzles are separately charged with a blasted air pressure at a pressure level different from the given pressure level.

Advantageously, the throttled nozzles are charged with a higher (approximately 5 times stronger) blasted air pressure than conventional free jet nozzles. It is expedient to dispose an additional sheet guiding device in back of the printing nip, the additional sheet guiding device having, in a region facing the air gap, at least one conventional nozzle (free jet nozzle) for peeling the freshly printed sheet from the inking cylinder, and also having "throttled blast nozzles" for uniform sheet guidance in a guide region located further from the printing nip.

It is also advantageous to develop the throttled nozzles such that each of the openings is connected to an air-pressure generator through an air throttle. The air throttle can be integrated into the air conducting system at a distance from the respective throttled air nozzle. The air throttle and the air nozzle that is throttled thereby may also form one structural unit in the form of a throttle nozzle. In such a case, a separate air throttle is allocated to each of the throttled air nozzles. But an air throttle can also be provided that is simultaneously pneumatically connected to several throttled air nozzles through the air conducting system.

In accordance with an additional feature of the invention, the throttled air blast nozzles are throttled air nozzles.

In accordance with yet another feature of the invention, there are provided at least one air throttle fluidically connected to the air blast nozzles.

In accordance with yet a further feature of the invention, a fill column is an internal component of the air throttle. The fill elements thereof form flow resistors for the blasted air or suction air that is generated by the air pressure generator and that flows though the air throttle.

In accordance with yet an added feature of the invention, the air throttle has a filter piece. Advantageously, an air-filter-type throttle piece is an internal component of the air throttle. The throttle piece forms a flow resistor for the suction air or blasted air. For example, the throttle piece may be a textile layer that may or may not be woven. The throttle piece may also be a porous and, therefore, air-permeable sponge formed from a plastic.

In accordance with again another feature of the invention, the air throttle has a spiral air channel.

In accordance with yet an additional feature of the invention, the air throttle contains air barriers that protrude into the flow path of the suction air or blasted air and that define eddy chambers disposed between the air barriers.

In accordance with again a further feature of the invention, the air throttle has perforated plates disposed on top of one another and eddy chambers disposed between the perforated plates.

In accordance with again an added feature of the invention, the air throttle is constructed as a perforated plate maze.

In accordance with again an additional feature of the invention, the throttled air blast nozzles are blast nozzles.

With the objects of the invention in view, there is also provided a sheet-fed rotary press for processing printing material sheets including a form cylinder, a rubber blanket cylinder, a sheet guiding cylinder, the sheet guiding cylinder and one of the form cylinder and the rubber blanket cylinder forming a printing nip parallel to the sheet guiding cylinder, and at least one sheet guide disposed in a region of the printing nip. The sheet guide has blast openings for guiding a sheet on the shell surface and the blast openings include a combination of free jet nozzles and throttled air blast nozzles.

Other features that are considered as characteristic for the invention are set forth in the appended claims.

Although the invention is illustrated and described herein as embodied in a device for guiding sheets in a sheet processing apparatus, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
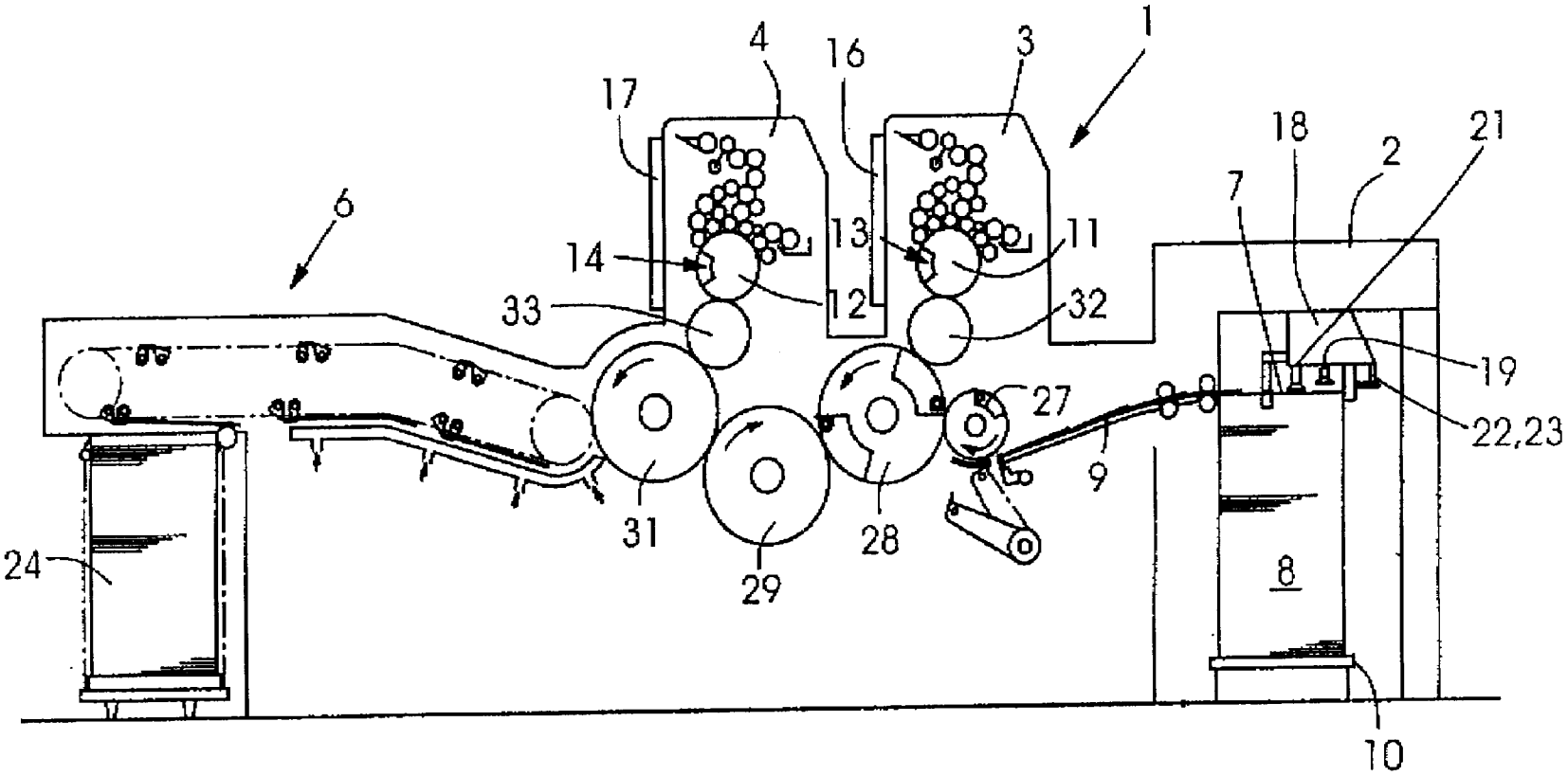
FIG. 1 a diagrammatic cross-sectional view of a sheet-processing apparatus according to the invention.

In all the figures of the drawing, sub-features and integral parts that correspond to one another bear the same reference symbol in each case. Related applications having the Application Serial Nos. (Attorney Docket Nos. A-2904, A-2935, and A-2936) are hereby incorporated herein by reference.

Referring now to the figures of the drawings in detail and first, particularly to FIG. 1 thereof, there is shown a rotary printing press, for instance, a printing press 1 that processes a sheet 7, includes a feeder 2, at least one printing unit 3 or 4, and a delivery 6. The sheets 7 are taken from a sheet stack 8 and fed to the printing units 3 and 4, individually or shingled, by way of a feed table 9. Each of these printing units contains a conventional plate cylinder 11, 12. The plate cylinders 11, 12 each include a device 13, 14 for fixing flexible printing plates. Beyond this, a device 16, 17 for semi-automatic or fully automatic printing plate exchange is allocated to each plate cylinder 11, 12.

The sheet stack 8 rests on a controllably liftable stack plate 10. The sheets 7 are removed from the top of the stack 8 by what is referred to as a suction head 18 that includes a number of lifting and dragging suckers 19, 21 for singularizing the sheets 7, among other components. Therebeyond is disposed a blasting device or means 22 for loosening the top layer of sheets and keying elements 23 for readjusting the stack are also provided. A number of lateral and rear stops are provided for aligning the sheet stack 8, particularly the top sheet 7 of the stack 8.

After the sheets 7 are processed, they are deposited on a stack 24 in the delivery 6. To be able to transport the sheets 7 from the feeder 2 to the delivery 6 through the printing units 3, 4, the cylinders 27, 28, 29, 31 that guide the sheets are equipped with a gripper mechanism. The cylinders 28 and 31 are printing cylinders, which, in offset printing, remain in contact with the rubber blanket cylinders 32, 33 of the printing units 3, 4.

In direct printing, the printing cylinders 28, 31 work directly in conjunction with form cylinders, whose printing plate is inked by the inking unit directly.

The invention relates to both offset printing and direct printing.

Figure 2:
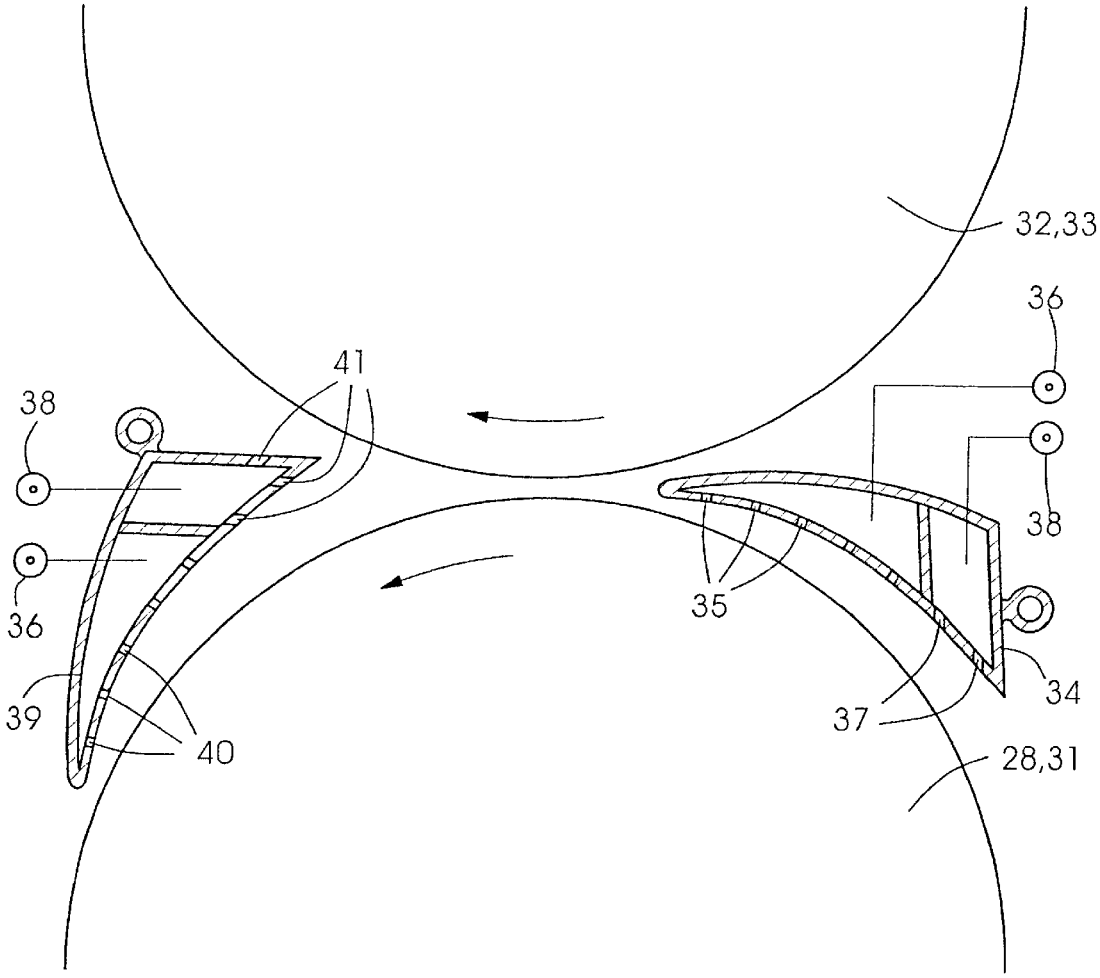
FIG. 2 a fragmentary, diagrammatic, cross-sectional view of a sheet guiding element according to the invention.

To guarantee a uniform sheet transport on the printing cylinder 28, 31, at least one swinging sheet guide element 34, preferably, a number of parallel, mutually spaced sheet guide elements 34 as shown in FIG. 2, is disposed in front of the printing nip (viewed in a sheet transport direction). On a bottom surface that faces the sheet 7, the sheet guide element 34 includes a number of throttled blast air nozzles 35 that are charged by a blasted air source 36. The part of the sheet guide element 34 that is provided with the throttled blast nozzles 35 protrudes deep into the printing nip and stands close to the printing cylinder 28, 31. On a bottom surface of the back part of the sheet guide element 34 that faces the sheet 7, there is at least one conventional free jet nozzle 37 that is charged by an additional blasted air source 38. A pressure $P_1$ of the blasted air source 36 is set higher than a pressure $P_2$ of the blasted air source 38 ($P_1>P_2$). The pressure $P_1$ is preferably 5 times as large as $P_2$. At least one swinging sheet guide element 39 is also disposed in back of the printing nip as well. It is advantageous to provide a number of mutually spaced parallel sheet guide elements 39.

In a front part that is situated close to the printing cylinder 28, 31, the sheet guide element 39 includes a number of throttled blast nozzles 40 that are charged by the blasted air source 36. The sheet guide element 39 also has, in a rear part, at least one conventional free jet nozzle 41 that supports the peeling of the freshly printed sheet 7 from the inking blanket cylinder 32, 33. The conventional free jet nozzles 41 are charged by the blasted air source 38.

The following air throttles are proposed for generating throttled blasted air at the openings 35 of the sheet guide element 34 and the openings 40 of the sheet guide element 39.

Figure 3:
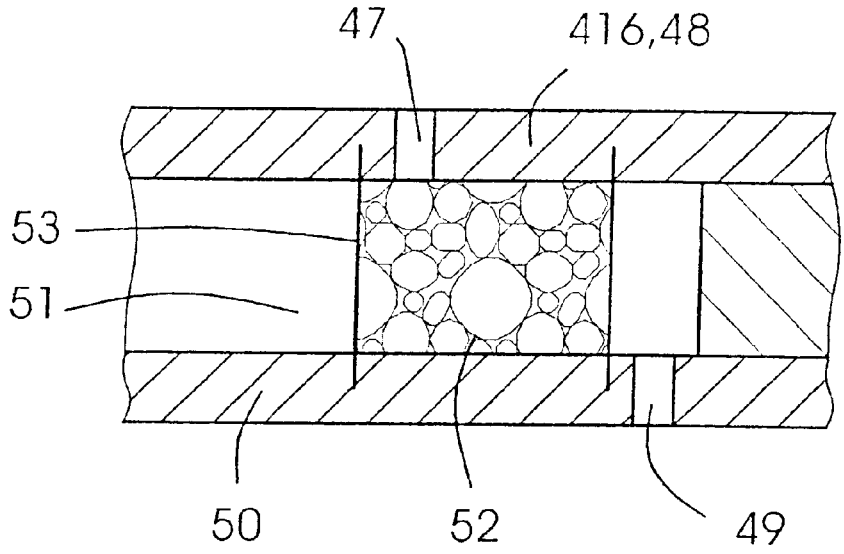
FIG. 3 is a fragmentary, cross-sectional view of an embodiment of an air throttle according to the invention.
Figure 4:
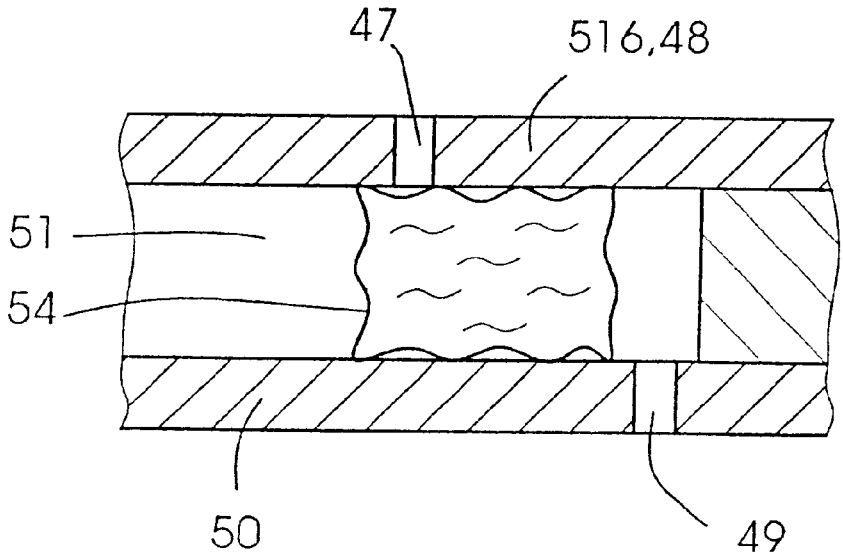
FIG. 4 is a fragmentary, cross-sectional view of a second embodiment of the air throttle of FIG. 3.

The components labeled with reference numerals 47 to 51 in FIG. 3 are also present in the variants of the air throttle 516, 616, 716, 816 illustrated in FIGS. 4 to 7. Thus, the reference numerals 47 to 51 are used again in FIGS. 4 to 7 without additional explanation. In the variants of the air throttle 516 represented in FIG. 4, the fill 52 is replaced by a textile throttle piece 54, for example, a fabric or fleece, which is inserted into the throttle chamber 51. In order to fill the throttle chamber 51 from bottom 50 to top 48 with the throttle piece 54, the throttle piece 54 can be made of a single layer of sufficient volume or can be wound into a multi-layered insert or stretched in the throttle chamber 51. The blasted air flowing through the throttle piece 54 is throttled in that it is dammed at threads or fibers and eddied in pores of the throttle piece 54.

Figure 5A:
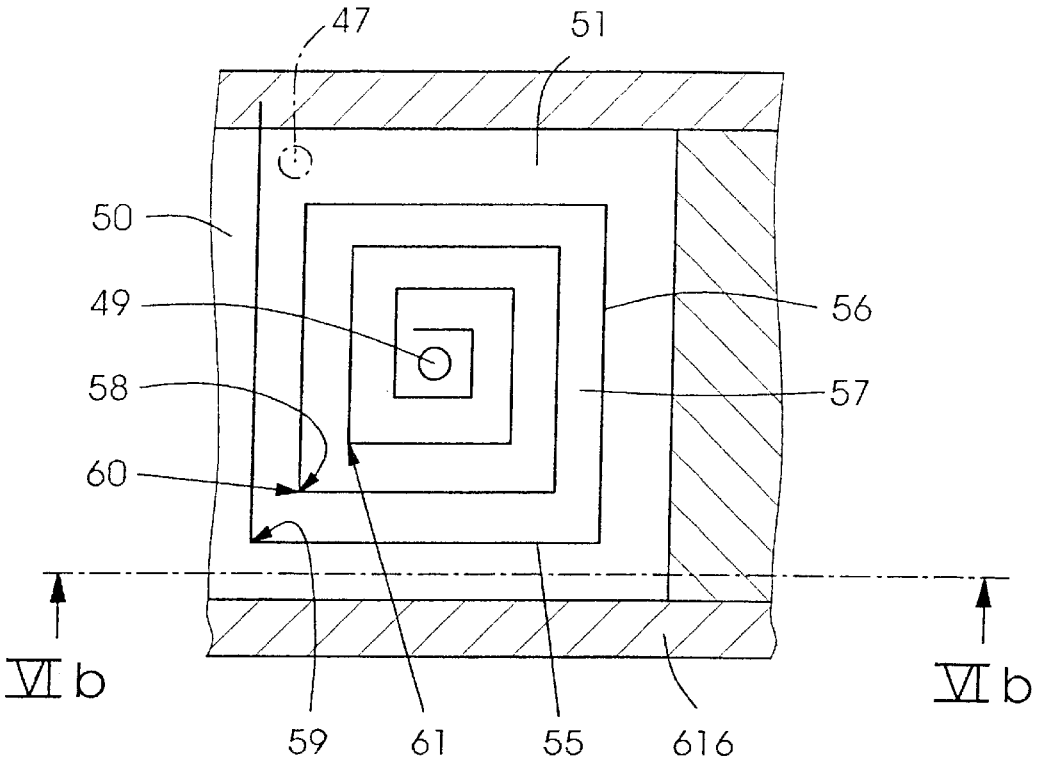
FIG. 5*a* is a fragmentary, cross-sectional plan view of a third embodiment of the air throttle of FIG. 3.
Figure 5B:
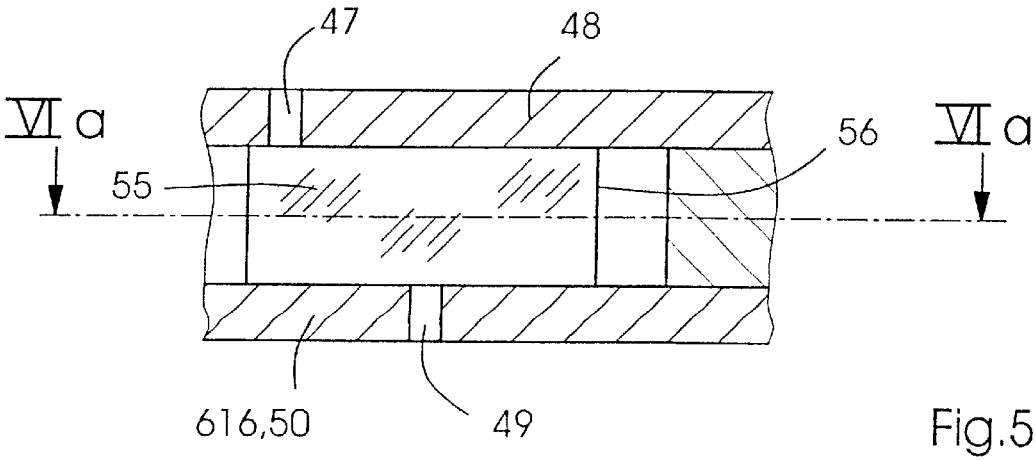
FIG. 5*b* is a fragmentary, cross-sectional side view of the embodiment of FIG. 6*a;*

FIG. 5*a* (a horizontal cross-section along the line VIa—VIa in FIG. 5*b*) and FIG. 5*b* (a vertical cross-section along the line VIb—VIb in FIG. 5*a*) represent an air throttle 616 whose air guide walls 55, 56 are disposed together orthogonally in the throttle chamber 51, producing an air channel 57 in the form of a polygonal spiral that conducts the blasted air from the throttle inlet 47 to the throttle outlet 49 between the air guide walls 55, 56. The suction air or blasted air flowing through the air channel builds up in corner angles 58, 59 of the air channel 57 and eddies at corner edges 60, 61 of the air guide walls 55, 56, so that the airflow is throttled. The air guide walls 55, 56 have a very strong surface abrasiveness that is brought about by sandblasting, for example, and that contributes to reducing the flow rate of the blasted air in the air channel 57 by increasing the friction.

Figure 6A:
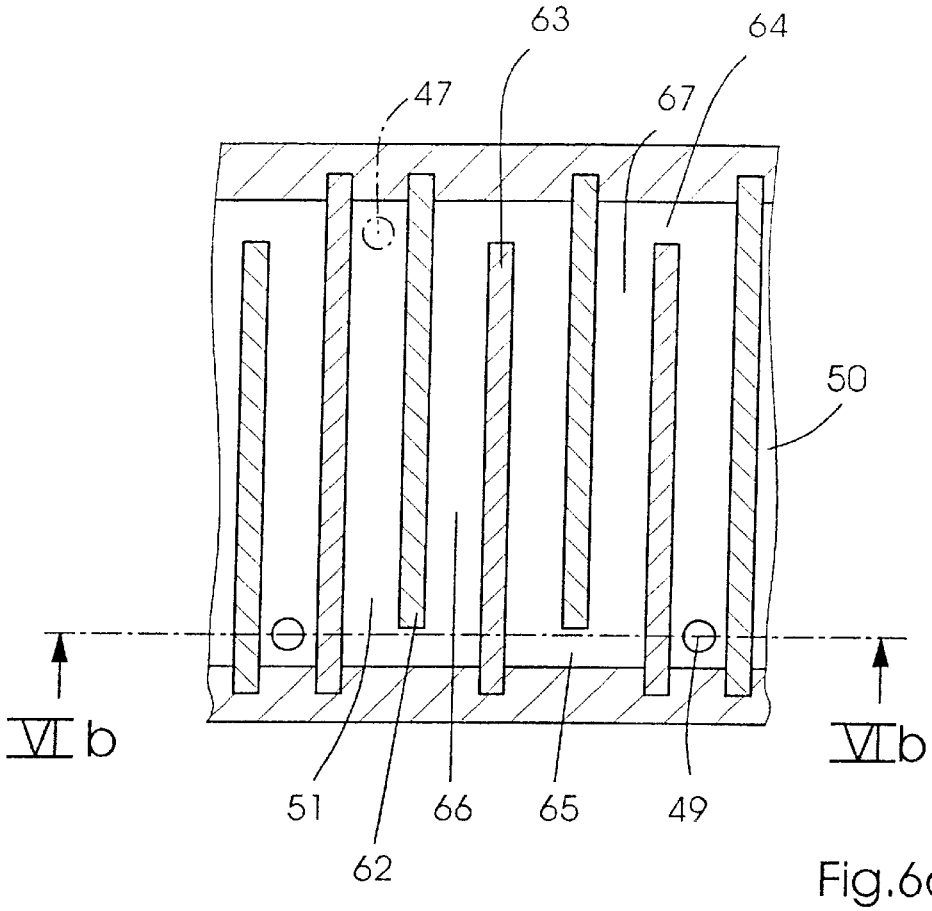
FIG. 6*a* is a fragmentary, cross-sectional plan view of a fourth embodiment of the air throttle of FIG. 3.
Figure 6B:
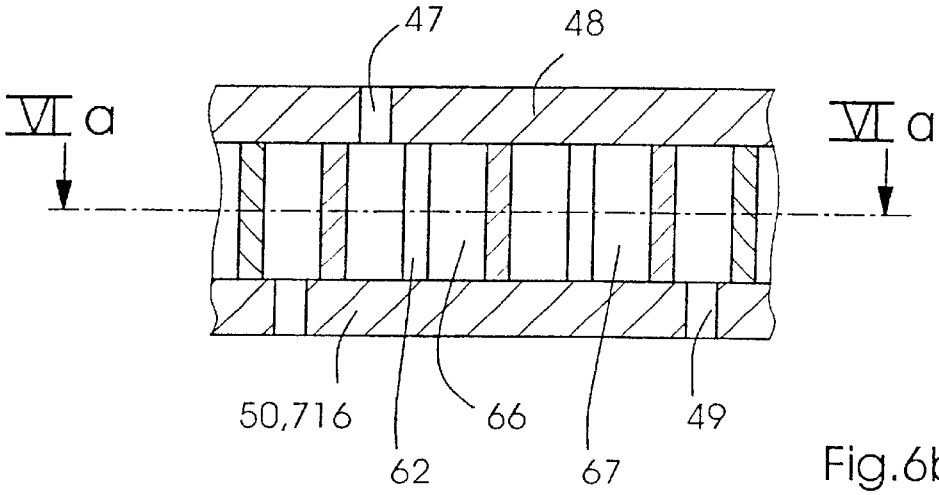
FIG. 6*b* is a fragmentary, cross-sectional side view of the embodiment of FIG. 7.

In the air throttle 716 (cf. FIG. 6*a* (horizontal section) and FIG. 6*b* (vertical section)), the throttle chamber 51 contains air barriers 62, 63 in the form of damming walls. The air barriers 62, 63 are disposed in two rows in alternation and overlapping one another up to the narrow air gaps 64, 65. Eddy chambers 66, 67 are located between the air barriers 62, 63 that, with the air gaps 64, 65, form a meandering air channel leading from the throttle inlet 47 to the outlet 49, in which the blasted air is throttled.

Figure 7:
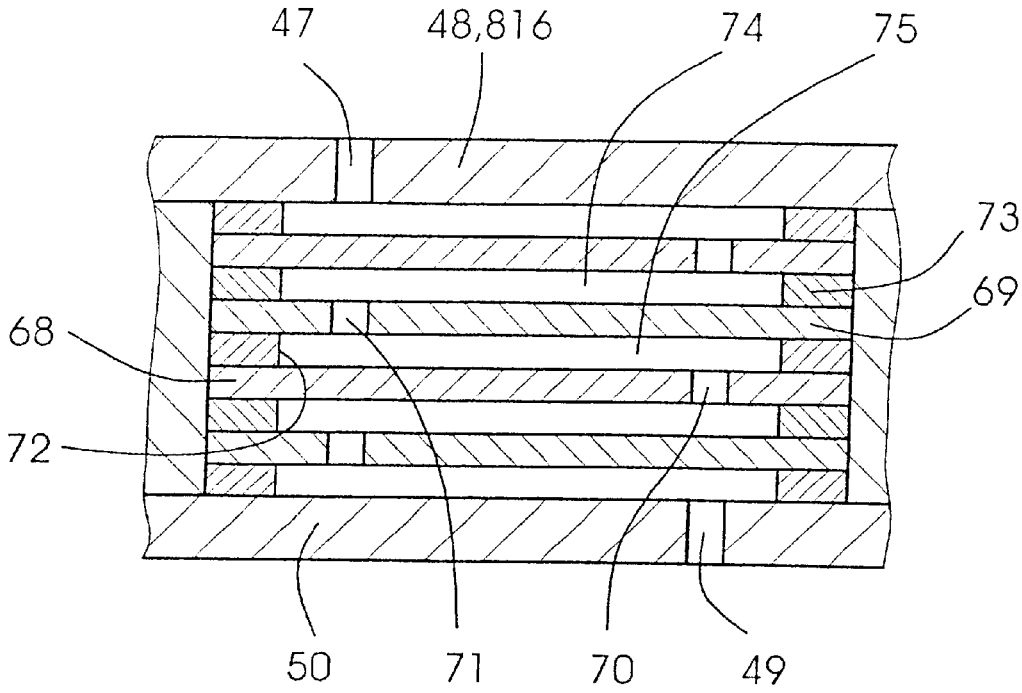
FIG. 7 is a fragmentary, cross-sectional view of a fifth embodiment of the air throttle of FIG. 3.

FIG. 7 illustrates a section of the air throttle 816 including perforated plates 68, 69 that are disposed on top of each other in the throttle chamber 51 sandwich-style. Each of the perforated plates 68, 69 include at least one hole 70, 71 that is disposed in the plate plane at an offset to at least one hole 71, 70 of the respective adjoining perforated plate. The holes 70, 71 are, thus, out of alignment with each other and overlap solid surfaces of the perforated plates 68, 69. The distance pieces 72, 73 (spacers) hold the perforated plates 68, 69 at a distance from one another and determine the volumes of eddy chambers 74, 75 that are located between the perforated plates 68, 69 and passed by the blasted air. The blasted air builds up in front of the holes 70, 71, which represent bottlenecks in the flow path, and the air eddies in the eddy chambers 74, 75. The throttle action of the air throttle 816, and likewise that of the throttles 616 and 716, is based on reducing the flow rate of the blasted air by the multiple deflection of the airflow in the throttle chamber 51.

We claim:

1. A device for guiding sheets in a sheet-fed apparatus having a form cylinder, a rubber blanket cylinder, and a sheet guiding cylinder, the device comprising:

at least one sheet guide disposed in a region of a printing nip formed between a sheet guiding cylinder and one of a form cylinder and a rubber blanket cylinder, the nip disposed parallel to the sheet guiding cylinder, and the sheet guiding cylinder having a shell surface;

said at least one sheet guide having blast openings for guiding a sheet on the shell surface; and said blast openings including a combination of:

free jet nozzles; and throttled air blast nozzles;

said throttled air blast nozzles being disposed closer to the sheet guide cylinder than said free jet nozzles.

2. The device according to claim 1, wherein:

said at least one sheet guide is at least two sheet guides;

one of said two sheet guides is disposed in front of the printing nip with respect to a sheet transport direction; and another of said two sheet guides is disposed behind the printing nip with respect to a sheet transport direction.

3. The device according to claim 1, wherein:

said throttled air blast nozzles are charged with a blasted air pressure at a given pressure level; and said free jet nozzles are separately charged with a blasted air pressure at a pressure level different from said given pressure level.

4. The device according to claim 1, wherein said throttled air blast nozzles are throttled air nozzles.

5. The device according to claim 1, wherein said throttled air blast nozzles are blast nozzles.

6. The device according to claim 1, including at least one air throttle fluidically connected to said air blast nozzles.

7. The device according to claim 6, wherein said at least one air throttle has a fill.

8. The device according to claim 6, wherein said at least one air throttle has a filter piece.

9. The device according to claim 6, wherein said at least one air throttle has a spiral air channel.

10. The device according to claim 6, wherein said at least one air throttle has protruding air barriers and eddy chambers disposed between said air barriers.

11. The device according to claim 6, wherein said at least one air throttle has perforated plates disposed on top of one another and eddy chambers disposed between said perforated plates.

12. A sheet-fed rotary press for processing printing material sheets, comprising:

a form cylinder;

a rubber blanket cylinder;

a sheet guiding cylinder having a shell surface, said sheet guiding cylinder and one of said form cylinder and said rubber blanket cylinder forming a printing nip parallel to said sheet guiding cylinder;

at least one sheet guide disposed in a region of said printing nip;

said at least one sheet guide having blast openings for guiding a sheet on the shell surface; and said blast openings including a combination of:

free jet nozzles; and throttled air blast nozzles;

said throttled air blast nozzles being disposed closer to the sheet guide cylinder than said free jet nozzles.

13. A device for guiding sheets in a sheet-fed apparatus having a form cylinder, a rubber blanket cylinder, and a sheet guiding cylinder, the device comprising:

at least one sheet guide disposed in a region of a printing nip formed between a sheet guiding cylinder and one of a form cylinder and a rubber blanket cylinder, the nip disposed parallel to the sheet guiding cylinder, and the sheet guiding cylinder having a shell surface;

said at least one sheet guide having blast openings for guiding a sheet on the shell surface;

said blast openings including a combination of:

free jet nozzles; and throttled air blast nozzles;

said throttled air blast nozzles being charged with a blasted air pressure at a given pressure level; and said free jet nozzles being separately charged with a blasted air pressure at a pressure level different from said given pressure level.

14. A sheet-fed rotary press for processing printing material sheets, comprising:

a form cylinder;

a rubber blanket cylinder;

a sheet guiding cylinder having a shell surface, said sheet guiding cylinder and one of said form cylinder and said rubber blanket cylinder forming a printing nip parallel to said sheet guiding cylinder;

at least one sheet guide disposed in a region of said printing nip;

said at least one sheet guide having blast openings for guiding a sheet on the shell surface;

said blast openings including a combination of:

free jet nozzles; and throttled air blast nozzles;

said throttled air blast nozzles being charged with a blasted air pressure at a given pressure level; and said free jet nozzles being separately charged with a blasted air pressure at a pressure level different from said given pressure level.

* * * * *